US008245465B2

(12) United States Patent
Bai

(10) Patent No.: US 8,245,465 B2
(45) Date of Patent: Aug. 21, 2012

(54) FASTENING DEVICE FOR CURTAIN WALL UNITS

(75) Inventor: Baokun Bai, Dongguan (CN)

(73) Assignee: Guangdong Kin Long Hardware Products Co., Ltd., Guangdong Province (CN)

( * ) Notice: Subject to any disclaimer, the term of this patent is extended or adjusted under 35 U.S.C. 154(b) by 41 days.

(21) Appl. No.: 12/874,515

(22) Filed: Sep. 2, 2010

(65) Prior Publication Data

US 2011/0056162 A1 Mar. 10, 2011

(30) Foreign Application Priority Data

Sep. 7, 2009 (CN) ..... 2009 2 0204817 U

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 14/00*** | (2006.01) |

(52) U.S. Cl. ..... 52/235; 52/459; 52/471; 52/665; 52/241

(58) Field of Classification Search ..... 52/235, 52/459, 471, 664, 665, 240, 241, 511, 584.1
See application file for complete search history.

(56) References Cited

U.S. PATENT DOCUMENTS

| | | | | |
|---|---|---|---|---|
| 5,040,347 | A * | 8/1991 | Valvis | 52/204.591 |
| 5,839,236 | A * | 11/1998 | Frey | 52/235 |
| 6,085,469 | A * | 7/2000 | Wolfe | 52/71 |
| 6,658,804 | B2 * | 12/2003 | Leytes et al. | 52/235 |
| 2001/0000274 | A1 * | 4/2001 | Elmer et al. | 52/235 |
| 2001/0023562 | A1 * | 9/2001 | Blobaum et al. | 52/235 |
| 2002/0124499 | A1 * | 9/2002 | Braybrook | 52/235 |
| 2003/0079426 | A1 * | 5/2003 | Riggio | 52/235 |
| 2003/0126813 | A1 * | 7/2003 | Leytes et al. | 52/235 |
| 2009/0249736 | A1 * | 10/2009 | Bai | 52/706 |

FOREIGN PATENT DOCUMENTS

CN 200820093082.9 * 4/2008

* cited by examiner

*Primary Examiner* — Mark Wendell
(74) *Attorney, Agent, or Firm* — Rosenberg, Klein & Lee

(57) ABSTRACT

A fastening device for curtain wall units includes a first clamping plate, a second clamping plate fixed to the first clamping plate and spaced apart from the first clamping plate, a first support plate positioned between the first clamping plate and the second clamping plate, and a second support plate hinged to the first support plate and configured to support the curtain wall units.

20 Claims, 5 Drawing Sheets

FASTENING DEVICE FOR CURTAIN WALL UNITS

BACKGROUND

1. Technical Field

The present disclosure relates generally to architectural hardware, and in particular to a fastening device for curtain wall units.

2. Description of Related Art

Glass curtain walls have been widely used as the outer wall of building. In recent decades, point-supported glass curtain wall has been widely used in large public facilities due to its high security, good light transmission, nice ornamentation, variety of structure, convenience for maintenance, high technology, and so on.

During the assembly of one type of the point-supported glass curtain wall, holes are generally defined on the edge portions of the glass curtain wall, and connecting elements are inserted into the holes to joint the glass curtain wall units which are then coupled to a supporting structure on the building by claw-shaped connectors. Thus, it is necessary to define holes on the four corners of the glass curtain wall unit respectively in order to carry out the assembly. As is well known, the holes on the friable glass should be generated by a special device, which is of relative low efficiency and also is a waste of time and effort, and the glass strength is reduced, easy to be broken and may raise security problems due to the holes on the four corners.

One solution that deals with the above problems is to provide a fastening device to clamp the curtain wall units. Referring to FIG. 1, a typical fastening device includes a front clamping plate, a rear clamping plate fixed to the front clamping plate, and a support plate located between the front clamping plate and the rear clamping plate. The curtain wall units are located between the front clamping plate and the rear clamping plate. However, this type of fastening device still has many disadvantages, for example, when the curtain wall moves horizontally or rotates a few degrees caused by wind load or shock, the contact surface between the glass curtain wall and the support plate will become a line (as shown in portion A in FIG. 1), such that the glass curtain wall may crack or be damaged due to the stress concentration.

Therefore, a fastening device which overcomes the described limitations is desired.

SUMMARY

One object of the present disclosure is to provide a fastening device for curtain wall units which has a higher stability and security.

In one embodiment, a fastening device for curtain wall units includes a first clamping plate; a second clamping plate fixed to the first clamping plate and spaced apart from the first clamping plate: a first support plate positioned between the first clamping plate and the second clamping plate; and a second support plate hinged to the first support plate and configured to support the curtain wall units.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
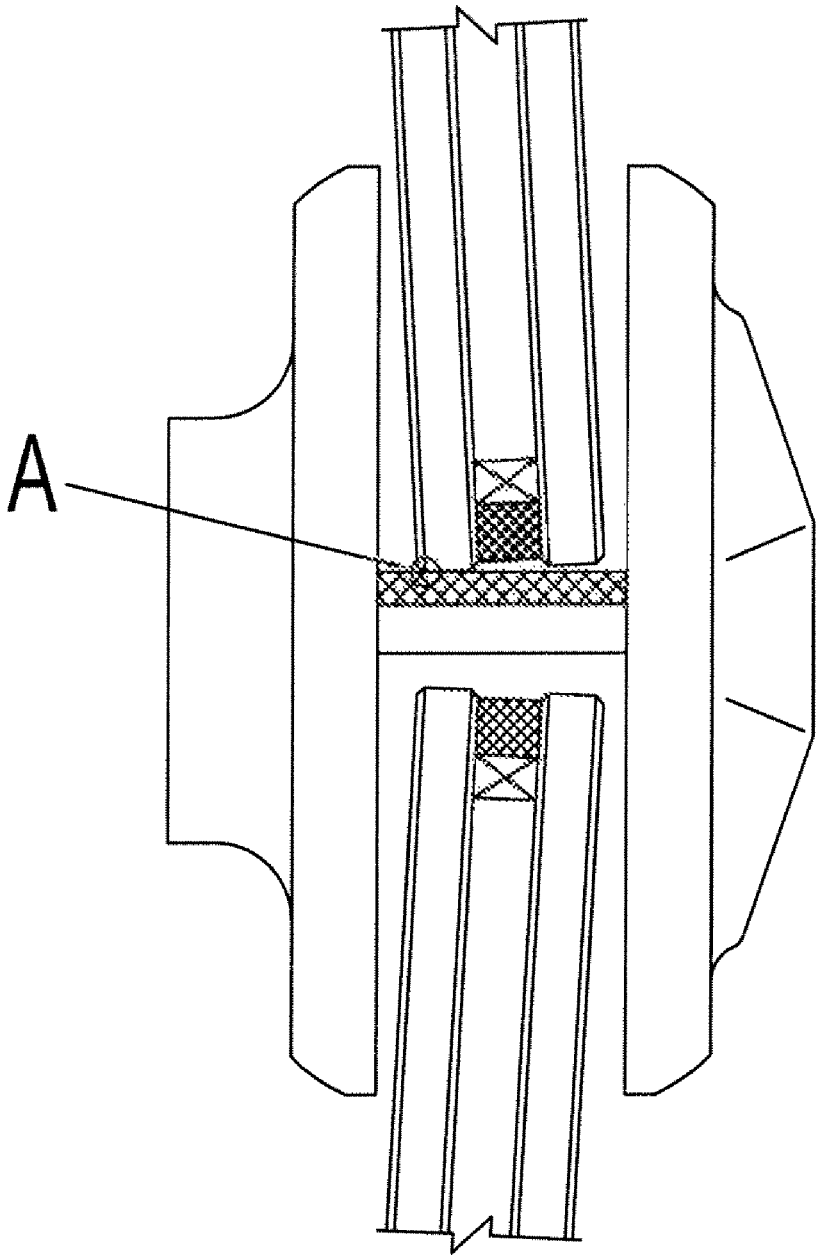
FIG. 1 RELATED ART
FIG. 1 is a schematic, front view of a conventional fastening device for curtain wall units.
Figure 2A:
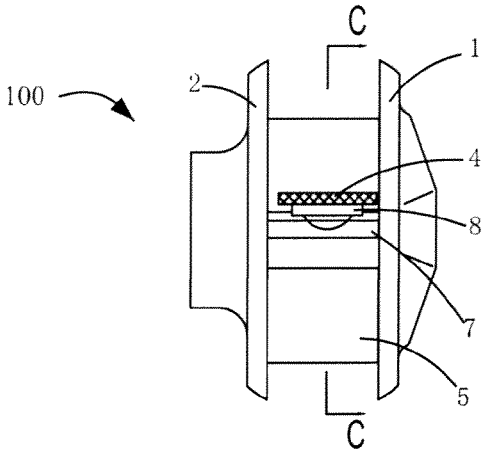
FIG. 2A is a schematic, front view of a first embodiment of a fastening device.
Figure 2B:
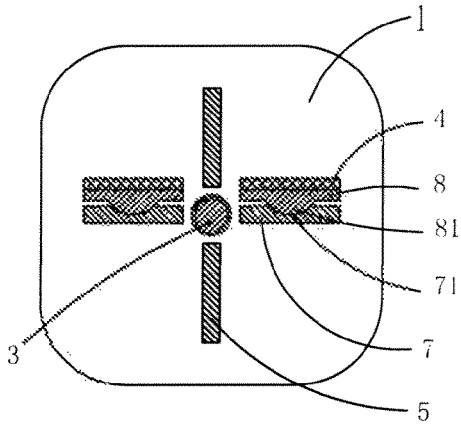
FIG. 2B is cross-sectional view taken along line C-C of FIG. 2A.
Figure 2C:
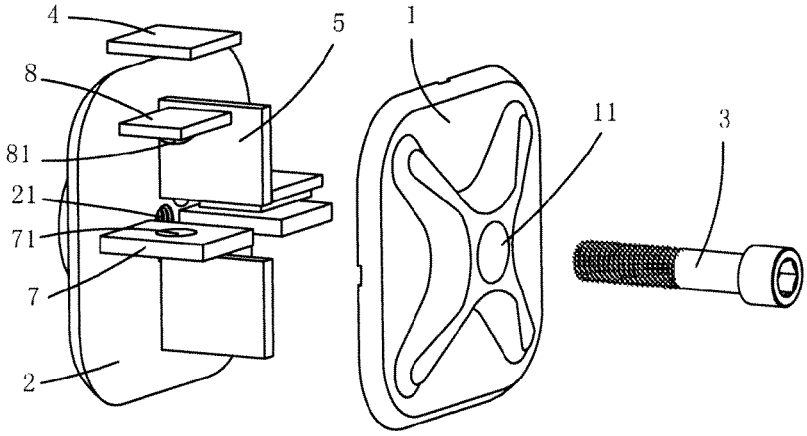
FIG. 2C is a schematic, exploded perspective view of the fastening device shown in FIG. 2A.

Referring to FIGS. 2A through 2C, a first embodiment of a fastening device 100 is used to retain curtain wall units 6. The fastening device 100 includes a first clamping plate 1, a second clamping plate 2, a screw 3, two washers 4, two spacer plates 5, two first support plates 7 and two second support plates 8.

The first clamping plate 1 is substantially rectangular and defines a through hole 11 at a center of the first clamping plate 1.

The second clamping plate 2 has substantially the same shape as the first clamping plate 1 and defines a threaded hole 21 at a center thereof corresponding to the through hole 11.

The screw 3 extends through the through hole 11 and threadedly engaged in the threaded hole 21, such that the second clamping plate 2 is fixed and spaced apart from the first clamping plate 1.

The two spacer plates 5 are positioned at a side surface of the second clamping plate 2 and each extending vertically substantially perpendicular to the second clamping plate 2. The two spacer plates 5 are substantially coplanar and located at an upper side and a lower side of an axis of the threaded hole 21. In other words, the two spacer plates 5 are arranged along a vertical central axis of the second clamping plate 2 to separate two horizontal adjacent curtain wall units 6. It should be understood that, the two spacer plates 5 may be positioned on the first clamping plate 1.

The two first support plates 7 are positioned between the first clamping plate 1 and the second clamping plate 2. The two first support plates 7 extends horizontally and are located at a right side and a left side of the axis of the threaded hole 21.

In other words, the two first support plates 7 are arranged along a horizontal central axis of the second clamping plate 2. Each first support plate 7 defines a depression 71 having a partial spherical surface on an upper side thereof. It should be understood that, the two first support plates 7 may be positioned on the first clamping plate 1.

Each second support plate 8 is substantially rectangular. The fastening device 100 further includes a ball member 81 formed on a side of the second support plate 8 facing the first support plate 7. The ball member 81 is partially received in the depression 71, such that the second support plate 8 is hinged to the first support plate 7 and is capable of rotating relative to a center of the depression 71.

Each washer 4 is positioned on the second support plate 8.

Figure 2D:
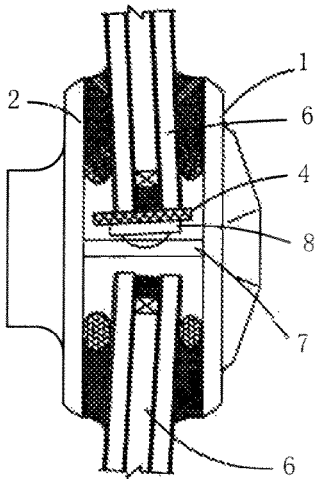
FIG. 2D is similar to FIG. 2A, but showing the fastening device used for retaining curtain wall units.
Figure 3A:
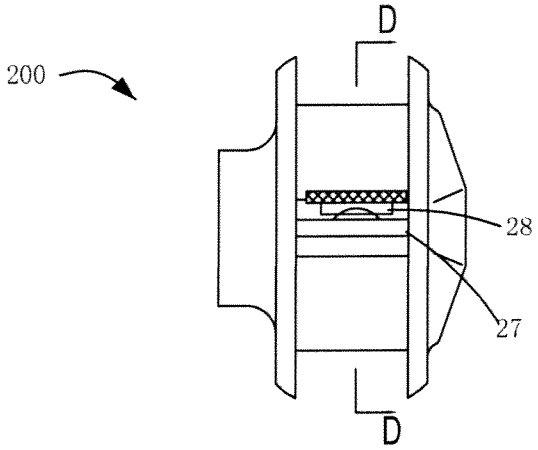
FIG. 3A is a schematic, front view of a second embodiment of a fastening device.
Figure 3B:
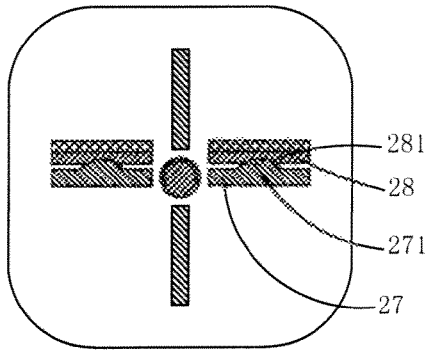
FIG. 3B is cross-sectional view taken along line D-D of FIG. 3A.
Figure 3C:
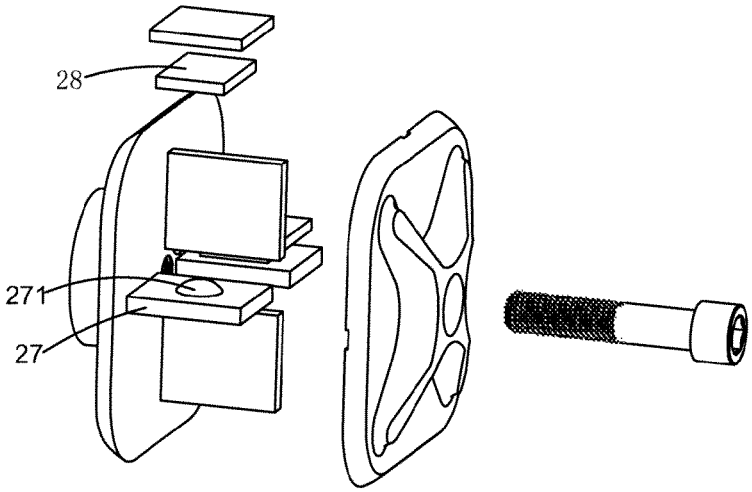
FIG. 3C is a schematic, exploded perspective view of the fastening device shown in FIG. 3A.
Figure 3D:
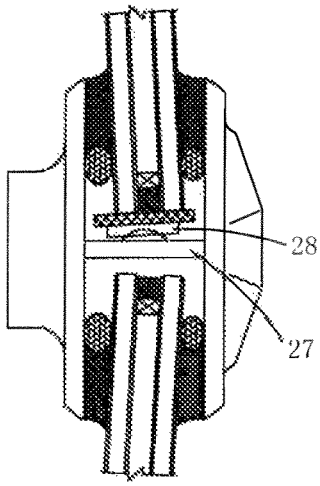
FIG. 3D is similar to FIG. 3A, but showing the fastening device used for retaining curtain wall units.
Figure 4A:
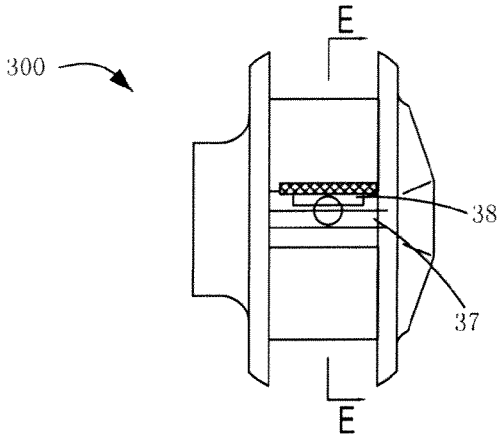
FIG. 4A is a schematic, front view of a third embodiment of a fastening device.
Figure 4B:
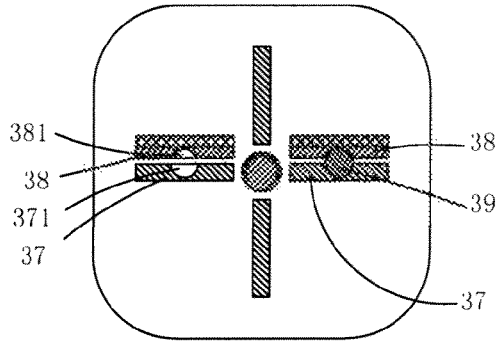
FIG. 4B is cross-sectional view taken along line E-E of FIG. 4A.
Figure 4C:
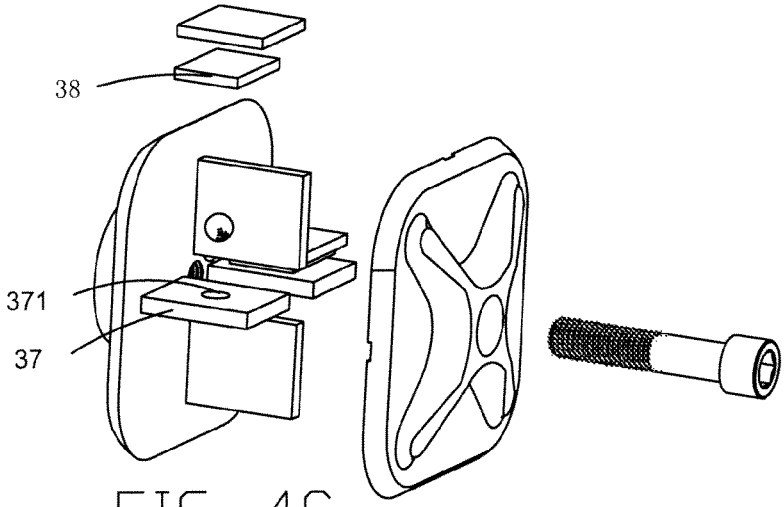
FIG. 4C is a schematic, exploded perspective view of the fastening device shown in FIG. 4A.
Figure 4D:
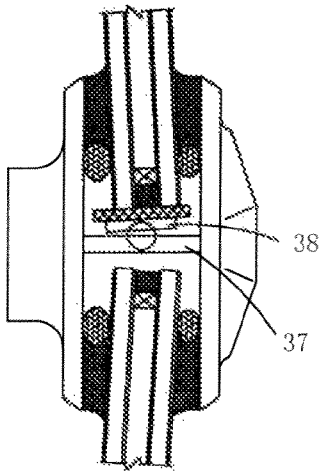
FIG. 4D is similar to FIG. 4A, but showing the fastening device used for retaining curtain wall units.

Referring to FIG. 2D, in assembly, four curtain wall units 6 are positioned at four corners of the fastening device 100, and each curtain wall unit 6 is supported by the first support plate 7 and the second support plate 8 placed below the curtain wall unit 6.

Since the second support plate 8 is hinged to the first support plate 7, the curtain wall unit 6 may slant a few angles relative to the fastening device 100, and it is adjustable in a three-dimensions space. During assembling, an angle may be formed by two adjacent curtain wall units 6, a curtain wall assembly with a curved or dentate surface is thus achieved. In addition, it can automatic compensate the transformation of the curtain wall units 6 caused by wind load, snow load, change of temperature, or even earthquake, therefore increasing the shock resistance and impact resistance of the curtain wall assembly. Moreover, when the curtain wall units 6 are being adjusted, the second support plate 8 is fully in surface contact with the curtain wall units 6, thus the stress concentration of a line contact in the related art can be avoided and increased reliability is achieved.

It is to be understood that, screw 3, the washers 4, and the spacer plates 5 may be omitted.

Referring to FIGS. 3A through 3D, a second embodiment of a fastening device 200 is similar to the fastening device 100, except for that, the ball member 271 is formed on the first support plate 27, and the depression 281 is defined on a side of the second support plate 28. The ball member 271 is partially received in the depression 281, such that the second support plate 28 is hinged to the first support plate 27.

Referring to FIGS. 4A through 4D, a third embodiment of a fastening device 300 is similar to the fastening device 100, except for that, the first support plate 37 defines a first depression 371 on a side thereof, the second support plate 38 defines a second depression 381 on a side thereof corresponding to the first depression 371, the fastening device 300 further includes a ball member 39 rotatably received in the first depression 371 and the second depression 381, such that the second support plate 38 is hinged to the first support plate 37.

Figure 5:
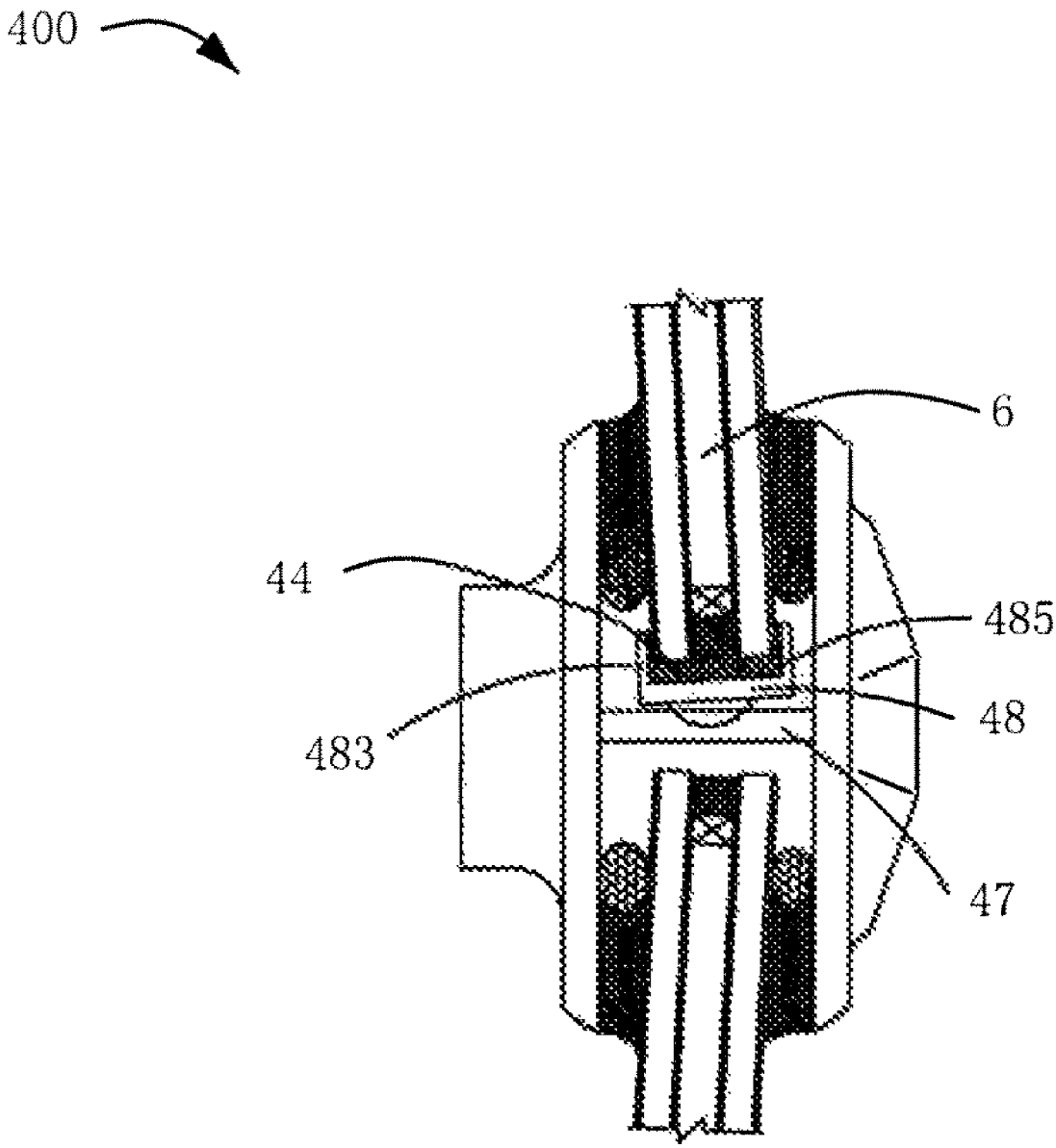
FIG. 5 is a schematic, front view of a fourth embodiment of a fastening device used for retaining curtain wall units.

Referring to FIG. 5, a four embodiment of a fastening device 400 is similar to the fastening device 100, except for that, it further includes two positioning plates 483 extending upwardly form two opposite ends of the second support plate 48. The two positioning plates 483 and the second support plate 48 corporately defines a mounting groove 485 to receive the curtain wall units 6, such that the curtain wall units 6 are firmly fixed to the second support plate 48. The washer 44 may also define a mounting groove (not labeled) to receive the curtain wall units 6.

The fastening devices described above may not be limited to used in point-supported type of glass curtain walls.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A fastening device for curtain wall units, comprising:
- a first clamping plate;
- a second clamping plate fixed to the first clamping plate and spaced apart from the first clamping plate;
- a first support plate positioned between the first clamping plate and the second clamping plate; and
- a second support plate hinged to the first support plate and configured to support the curtain wall units;
- wherein the first support plate defines a depression on a side thereof, the fastening device further comprises a ball member fixed to the second support plate, the ball member is rotatably received in the depression.

2. The fastening device of claim 1, wherein the first support plate is positioned along a horizontal central axis of the second clamping plate.

3. The fastening device of claim 1, wherein the first support plate is positioned along a horizontal central axis of the first clamping plate.

4. The fastening device of claim 1, further comprising two positioning plates extending upwardly form two ends of the second support plate, the two positioning plates and the second support plate cooperatively defines a mounting groove to receive the curtain wall units.

5. The fastening device of claim 1, further comprising a washer positioned between the second support plate and the curtain wall units.

6. The fastening device of claim 1, further comprising a screw, the first clamping plate defines a through hole at a center thereof, the second clamping plate defines a threaded hole at a center thereof corresponding to the through hole, the screw extends through the through hole and threadedly engaged in the threaded hole.

7. The fastening device of claim 1, further comprising a spacer plate positioned adjacent to a vertical central axis of the first or the second clamping plate to separate the curtain wall units.

8. A fastening device for curtain wall units, comprising:
- a first clamping plate;
- a second clamping plate fixed to the first clamping plate and spaced apart from the first clamping plate;
- a first support plate positioned between the first clamping plate and the second clamping plate; and
- a second support plate hinged to the first support plate and configured to support the curtain wall units;
- wherein the first support plate defines a first depression on a side thereof, the second support plate defines a second depression on a side thereof corresponding to the first depression, the fastening device further comprises a ball member rotatably received in the first depression and the second depression.

9. The fastening device of claim 8, wherein the first support plate is positioned along a horizontal central axis of one of the first and second clamping plates.

10. The fastening device of claim 8, further comprising two positioning plates extending upwardly form two ends of the second support plate, the two positioning plates and the second support plate cooperatively defines a mounting groove to receive the curtain wall units.

11. The fastening device of claim 8, further comprising a washer positioned between the second support plate and the curtain wall units.

12. The fastening device of claim 8, further comprising a screw, the first clamping plate defines a through hole at a center thereof, the second clamping plate defines a threaded hole at a center thereof corresponding to the through hole, the screw extends through the through hole and threadedly engaged in the threaded hole.

13. The fastening device of claim 8, further comprising a spacer plate positioned adjacent to a vertical central axis of the first or the second clamping plate to separate the curtain wall units.

14. A fastening device for curtain wall units, comprising:

a first clamping plate;

a second clamping plate fixed to the first clamping plate and spaced apart from the first clamping plate;

a first support plate positioned between the first clamping plate and the second clamping plate;

a second support plate hinged to the first support plate and configured to support the curtain wall units; and two positioning plates extending upwardly from two ends of the second support plate, the two positioning plates and the second support plate cooperatively defines a mounting groove to receive the curtain wall units.

15. The fastening device of claim 14, wherein the first support plate defines a depression on a side thereof, the fastening device further comprises a ball member fixed to the second support plate, the ball member is rotatably received in the depression.

16. The fastening device of claim 15, further comprising a spacer plate positioned adjacent to a vertical central axis of the first or the second clamping plate to separate the curtain wall units.

17. The fastening device of claim 14, wherein the second support plate defines a depression on a side thereof, the fastening device further comprises a ball member fixed to the first support plate, the ball member is rotatably received in the depression.

18. The fastening device of claim 14, wherein the first support plate defines a first depression on a side thereof, the second support plate defines a second depression on a side thereof corresponding to the first depression, the fastening device further comprises a ball member rotatably received in the first depression and the second depression.

19. The fastening device of claim 14, further comprising a washer positioned between the second support plate and the curtain wall units.

20. The fastening device of claim 14, further comprising a screw, the first clamping plate defines a through hole at a center thereof, the second clamping plate defines a threaded hole at a center thereof corresponding to the through hole, the screw extends through the through hole and threadedly engaged in the threaded hole.

* * * * *